US006698353B2

(12) United States Patent
Chou et al.

(10) Patent No.: US 6,698,353 B2
(45) Date of Patent: Mar. 2, 2004

(54) APPARATUS AND METHOD FOR LITHOGRAPHIC PRINTING UTILIZING A PRECISION EMULSION INK FEEDING MECHANISM

(76) Inventors: Shem-Mong Chou, 827 S. Wilmette, Westmont, IL (US) 60559; Thaddeus A. Niemero, 6103 Ivanhoe Ave., Lisle, IL (US) 60532; Xin Xin Wang, 740 Century Farm La., Naperville, IL (US) 60563; Thomas W. Orzechowski, 15257 Coventry Ct., Orland Park, IL (US) 60462; Joseph Vucko, 701 Kruk St., Lemont, IL (US) 60439

( * ) Notice: Subject to any disclaimer, the term of this patent is extended or adjusted under 35 U.S.C. 154(b) by 0 days.

(21) Appl. No.: 09/989,310

(22) Filed: Nov. 20, 2001

(65) Prior Publication Data

US 2003/0205154 A1 Nov. 6, 2003

Related U.S. Application Data

(63) Continuation of application No. 08/923,010, filed on Sep. 3, 1997, now Pat. No. 6,318,259.

(51) Int. Cl.[7] ..... B41F 31/00; B41J 2/18

(52) U.S. Cl. ..... 101/349.1; 101/350.1; 347/89

(58) Field of Search ..... 101/349.1, 348, 101/335, 340, 344, 347, 350.1, 355, 360, 363, 367; 347/89; 324/634, 640, 643, 664, 689, 694

(56) References Cited

U.S. PATENT DOCUMENTS

| | | | | |
|---|---|---|---|---|
| 2,154,544 A | | 4/1939 | Taylor | 101/350 |
| 2,177,656 A | | 10/1939 | Kaddeland | 101/157 |
| 2,366,375 A | | 1/1945 | Worthington | 101/364 |
| 3,045,592 A | | 7/1962 | Shearer et al. | 101/350 |
| 3,137,137 A | | 6/1964 | Källe | 60/52 |
| 3,958,509 A | | 5/1976 | Murray et al. | 101/426 |
| 4,064,801 A | | 12/1977 | Switall | 101/147 |
| 4,085,672 A | | 4/1978 | Grosart | 101/169 |
| 4,281,597 A | | 8/1981 | Dressler | 101/366 |
| 4,329,923 A | | 5/1982 | Iida | 101/365 |
| 4,388,864 A | | 6/1983 | Warner | 101/148 |
| 4,407,159 A | | 10/1983 | Wytaniec | 73/290 R |
| 4,461,211 A | | 7/1984 | Wesselmann et al. | 101/366 |
| 4,523,854 A | * | 6/1985 | Beckley | 366/132 |
| 4,527,479 A | | 7/1985 | Dahlgren et al. | 101/450.1 |
| 4,559,493 A | | 12/1985 | Goldberg et al. | 324/61 R |
| 4,595,933 A | * | 6/1986 | Mayer | 347/89 |
| 4,658,207 A | | 4/1987 | Scribano et al. | 324/61 P |
| 4,690,055 A | | 9/1987 | Fadner et al. | 101/148 |
| 4,787,313 A | | 11/1988 | Osborn et al. | 101/366 |
| 4,864,925 A | | 9/1989 | Van Kanegan et al. | 101/141 |
| 5,027,706 A | | 7/1991 | Niemiro et al. | 101/366 |

(List continued on next page.)

FOREIGN PATENT DOCUMENTS

| | | |
|---|---|---|
| EP | 0 355 590 | 2/1990 |

*Primary Examiner*—Andrew H. Hirshfeld
*Assistant Examiner*—Hoai-An D. Nguyen
(74) *Attorney, Agent, or Firm*—Marshall, Gerstein & Borun LLP

(57) ABSTRACT

A control system for regulating the composition of an emulsion ink made from an oil-based ink and a water-based fountain solution using a mixing and dispersing apparatus includes a liquid level sensor, means responsive to the liquid level sensor for maintaining a proper liquid level in the mixing and dispersing apparatus, and means for producing an emulsion ink with a water content value which is within a predetermined range from a desired water content value. The producing means includes a feedforward controller and a feedback controller for regulating water-based fountain solution input rate to the mixing and dispersing apparatus.

18 Claims, 9 Drawing Sheets

U.S. PATENT DOCUMENTS

| | | | | |
|---|---|---|---|---|
| 5,044,274 | A | | 9/1991 | Gaunt ..... 101/451 |
| 5,088,402 | A | | 2/1992 | Hycner et al. ..... 101/142 |
| 5,105,739 | A | | 4/1992 | Osawa et al. ..... 101/365 |
| 5,224,421 | A | | 7/1993 | Doherty ..... 101/211 |
| 5,280,750 | A | | 1/1994 | Yoshida et al. ..... 101/363 |
| 5,303,649 | A | | 4/1994 | Reder et al. ..... 101/363 |
| 5,315,930 | A | | 5/1994 | Niemiro ..... 101/366 |
| 5,372,067 | A | | 12/1994 | Doyle ..... 101/148 |
| 5,438,921 | A | * | 8/1995 | Hasegawa ..... 101/116 |
| 5,694,974 | A | | 12/1997 | Niemiro et al. ..... 137/392 |
| 5,735,205 | A | * | 4/1998 | Nordgren ..... 101/181 |
| 5,927,200 | A | | 7/1999 | Chou et al. ..... 101/366 |

* cited by examiner

APPARATUS AND METHOD FOR LITHOGRAPHIC PRINTING UTILIZING A PRECISION EMULSION INK FEEDING MECHANISM

RELATED APPLICATIONS

This application is a continuation filed U.S. application Ser. No. 08/923, 010, filed Sep. 3, 1997 now U.S. Pat. No. 6,318,259.

FIELD OF THE INVENTION

The present invention is generally related to a method and apparatus for lithographic printing using emulsion ink and, more particularly, a method and apparatus for feeding emulsion ink to a plate cylinder of a lithographic printing press.

BACKGROUND OF THE INVENTION

In a conventional lithographic printing process, an inking system is used to feed ink to the image areas of the printing plate and a separate dampening system is used to dampen the non-image areas of the printing plate. The water provided for dampening is more or less uniform across the press, while the ink input is regulated according to the image coverage of each printing zone and hence varies across the press. Such conventional processes have numerous drawbacks. The print quality is highly sensitive to the quality of the dampening systems, which are complex, expensive, difficult to maintain and take up valuable space. Great skill is required of the press operators to ensure that the proper ink/water ratio (i.e., ink/water balance) is maintained across the press during printing.

A relatively long start-up time is required before the ink/water balance reaches a steady state, and print quality varies during the start-up time. The time for the press to reach a steady state after a change in the ink feed rate is inversely proportional to the image coverage of each printing zone. Press operators commonly adjust the ink feed rate before the press has reached a steady state condition and hence end up chasing after a target print density constantly throughout an entire press run. This also accounts for inconsistent print quality. When the optical print density is lower than the target value, it could be caused by either insufficient ink supply or too much water supply. It requires a skilled crew to make the correct adjustment. Failure to do so may eventually result in tremendous print waste.

Ink input requirements vary across the press, which adds complexity to the printing process control, especially for a large newspaper press which may have as many as a thousand ink keys that need to be adjusted.

The aforementioned difficulties associated with presses having separate ink supply and dampening systems have prompted the development of systems using a single fluid for both inking and dampening: emulsion ink. Emulsion inks used in lithography are made from an emulsion of an oil-based ink and a water-based fountain solution. The emulsion ink is applied to a printing plate (typically mounted on a plate cylinder) having distinct image areas and non-image areas. The image areas have an oleophilic material, such as an oleophilic polymer, disposed on the surface thereof, so that the oil-based ink will adhere thereto for subsequent transfer to a printing substrate, such as a paper web. The non-image areas have a hydrophilic material, such as an aluminum oxide, disposed on the surface thereof, so that the water-based fountain solution will adhere thereto, thereby forming a protective film over the non-image areas, to prevent ink from adhering thereto. A principal advantage of the use of emulsion inks is that emulsion inks can eliminate the need for a separate system to dampen the printing plate and hence eliminates printing problems associated with keeping the ink/water properly in balance. Also, using emulsion inks simplifies the printing process by eliminating the need for many ink keys that would otherwise be required in presses using separate dampening and inking systems, i.e., to account for variations in image density.

However, a major drawback of the use of emulsion inks is that emulsion inks are often unstable (i.e. the oil-based ink and water-based fountain solution separate into distinct liquid layers). Such instability is undesirable because it interferes with ink transfer. For example, if the emulsion ink is not stable enough, the oil-based ink and water-based fountain solution will separate prematurely, before reaching the printing plate, resulting in scumming and wash marks, as water released from the emulsion ink will interfere with ink transfer by (a) reducing the amount of emulsion ink fed to the printing plate and (b) flushing across image areas of the printing plate. However, if the emulsion ink is overly stable, it will not release a sufficient amount of water to the printing plate to keep the non-image areas of the printing plate free of ink. Accordingly, the emulsion ink is formulated to have a stability that is within a "window" between being too stable and too unstable for satisfactory litho-graphic printing. It has been found that suitable emulsion inks have a water content of at least 35% by weight.

Also, because the viscosity of lithographic inks is relatively high, about 10 to a few hundred poises, lithographic inks generally do not flow freely. As water is dispersed into a matrix of lithographic ink to produce emulsion inks, the flow properties further deteriorate, making the formation of a suitably stable emulsion ink difficult.

Accordingly, when using emulsion ink, it is often necessary to adjust the ink/water balance during operation of the printing press. With existing press configurations, the adjustment will not take effect until the emulsion ink needing adjustment is substantially used up.

DETAILED DESCRIPTION OF THE PREFERRED EMBODIMENTS

The embodiments described herein are not intended to be exhaustive or to limit the scope of the invention to the precise form or forms disclosed. Instead, the following embodiments have been described in order to best explain the principles of the invention and to enable others skilled in the art to follow its teachings.

Figure 1:
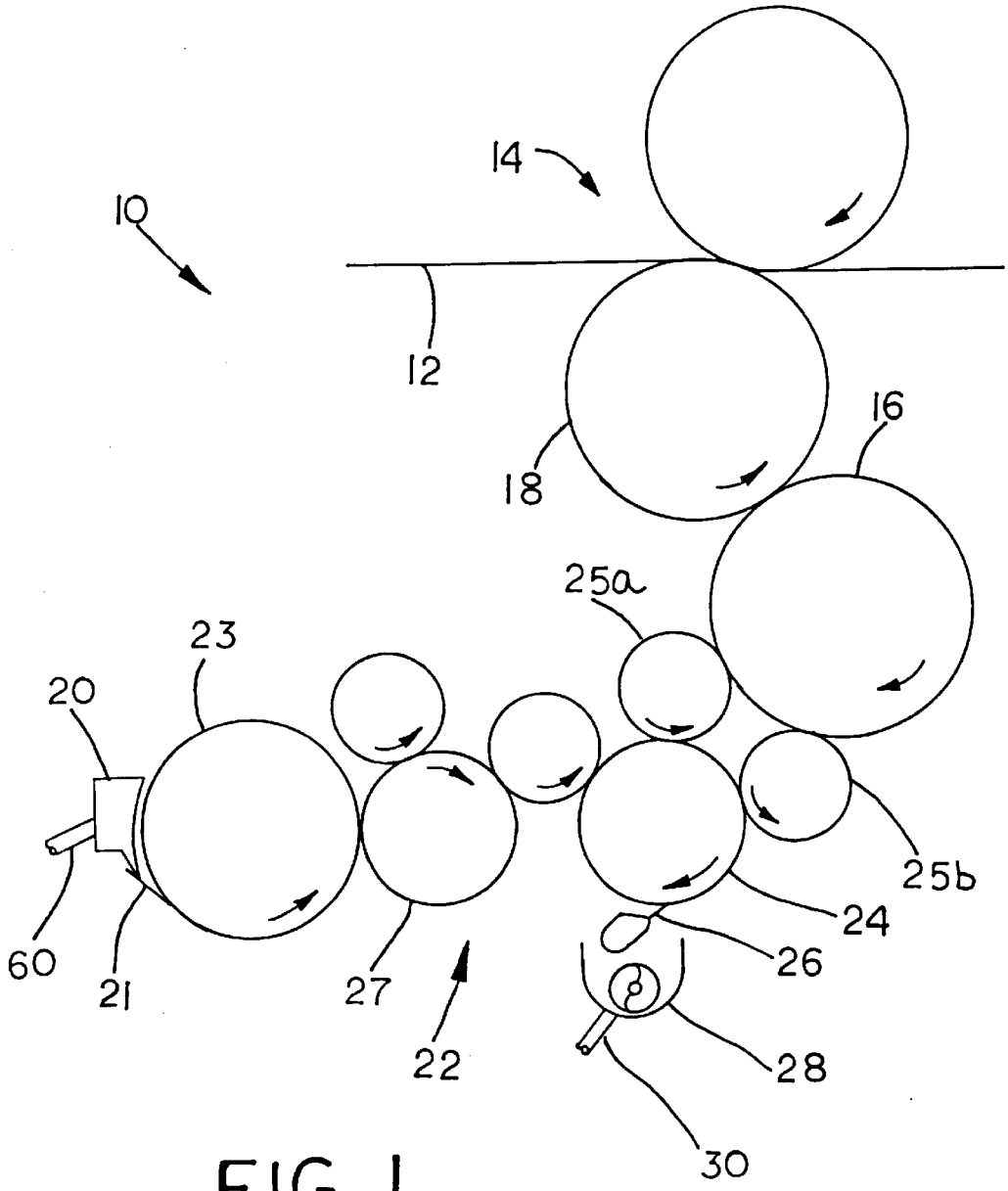
FIG. 1 is a schematic diagrammatic view of a printing press incorporating a precision emulsion ink feeding mechanism in accordance with the present invention.

In the illustrations given, and with reference first to FIG. 1, there is shown a printing press generally designated 10 for printing an image on a paper web 12. The press 10 has a printing unit 14 for printing ink on the web 12. Although not shown, the press 10 may include one or more additional printing units that may each be used, for example, for printing a different color of ink on the web 12.

The printing unit 14 has a plate cylinder 16 associated with a blanket cylinder 18. During printing by the press 10, an image of the ink is transferred from the plate cylinder 16 to the blanket cylinder 18 to print the image on one surface of the web 12. An emulsion ink, made up of an oil-based ink and a water-based fountain solution, is fed to the plate cylinder 16 from a digitally-controlled gear pump ink injector unit 20 through a plurality of distribution rollers 22, including a fountain roller 23, an auxiliary vibrator drum 27, a vibrator/scraper drum 24, and a pair of form rollers 25*a* and 25*b*. A smoothing blade 21 is mounted to the gear pump injector unit 20 and contacts the surface of the fountain roller 23 in order to evenly spread the emulsion ink onto the fountain roller 23. The surface of the fountain roller 23 is covered with a brush surface made from a material available commercially as Part No. 2A3 from Kanebo USA Inc., 693 5th Avenue, 17th Floor, New York, N.Y. 10022. This material is similar to the "loop" portion of so-called "hook and loop" fasteners, such as VELCRO®. The vibrator/scraper drum 24 has a wear-resistant, oleophilic/hydrophobic surface that collects excess emulsion ink that is in turn scraped off of the vibrator/scraper drum 24 by a doctor blade 26 and collected for re-use by an auger and scraper assembly 28, forming part of an ink feed and recirculation system 29, shown schematically in FIG. 2. The auxiliary vibrator drum 27 and the vibrator/scraper drum 24 oscillate in an axial direction (i.e., in a direction perpendicular to the plane of the paper in FIG. 1) to help ensure that a uniform emulsion ink film is supplied to the plate cylinder 16 and to prevent the formation of ridges on the emulsion ink film.

The fountain roller 23 rotates at a maximum speed of about 60 revolutions per minute, and proportionally slower as press speed is slowed. The rotation of the fountain roller 23 is thus quite slow in comparison to the rotation of the auxiliary vibrator drum 27, which typically rotates at a speed of about 1,000 revolutions per minute when the press 10 is operating.

The inking rollers (i.e. the fountain roller 23, the form rollers 25*a*, 25*b*, and those rollers therebetween) are driven by a separate motor so that the inking rollers may be driven while the plate cylinder 16 and the blanket cylinder 18 are stationary. Therefore, the inking rollers may be driven at press startup until an acceptable emulsion ink has been formed by the ink feed and recirculation system 29, thereby minimizing print waste during press startup.

Figure 2:
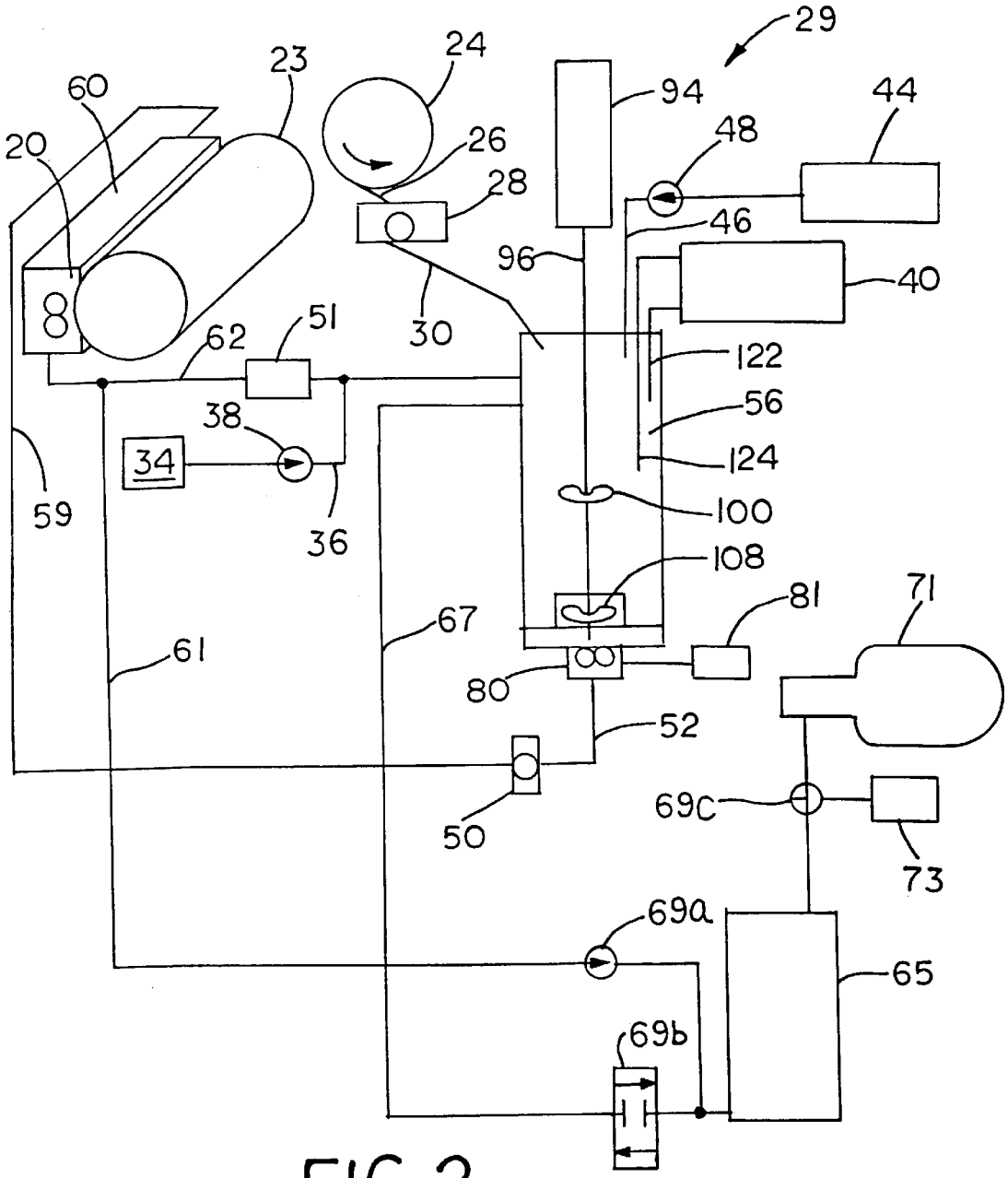
FIG. 2 is a schematic diagrammatic view of the emulsion ink feeding mechanism.

With reference to FIG. 2, the collected excess ink is transported by the auger and scraper assembly 28 to a conduit 30 which feeds a mixing and dispersing apparatus 56. Fresh ink is fed to the mixing and dispersing apparatus 56 from an ink supply reservoir 34 through a conduit 36. The flow of fresh ink through the conduit 36 is controlled by a new ink valve 38 that is responsive to a liquid level sensor 40 that senses the level of liquid in the mixing and dispersing apparatus 56. If the liquid level sensor 40 determines an overflow level of liquid, emulsion ink via conduit 62 is diverted to a conduit 61 and into an auxiliary reservoir 65. Liquid from the auxiliary reservoir 65 may be used again by feeding it back to the mixing and dispersing apparatus 56 via a conduit 67. Liquid discharge into or out of the auxiliary reservoir 65 is controlled via solenoid valves 69*a*, 69*b*, and 69*c* and by air depressurizing (discharge into) or air pressurizing (discharge out of) the auxiliary reservoir 65. The solenoid valve 69c can connect the auxiliary reservoir 65 to either a shop air system 71, providing air pressure of from about 40 psi (about 276 kPa) to about 70 psi (about 483 kPa), for pressurizing the auxiliary reservoir 65, or an ambient air source 73, providing air at an ambient pressure of about 14.7 psi (about 101 kPa), for depressurizing the auxiliary reservoir 65. If desired, a vacuum source may be substituted for the ambient air source 73, in order to provide air at an even lower pressure.

Fresh fountain solution (or clean water, as the case may be) is fed to the mixing and dispersing apparatus 56 from a fountain solution supply reservoir 44 through a conduit 46. The flow of fresh fountain solution through the conduit 46 is controlled by a valve 48 that is responsive to a water content sensor 50 that senses the percentage of water flowing out of the mixing and dispersing apparatus 56 in an outlet conduit 52. The emulsion ink is fed to an ink distribution rail 60 via a conduit 59. The ink distribution rail 60 in turn feeds the digitally-controlled gear pump ink injector unit 20. Unused emulsion ink is continuously recirculated to the mixing and dispersing apparatus 56 via the return conduit 62. This continuous recirculation of unused emulsion ink via the return conduit 62 is in addition to the ink scraped off of the vibrator/scraper drum 24 and returned to the mixing and dispersing apparatus 56 via the conduit 30. The continuous recirculation of emulsion ink ensures that the emulsion ink remains stable and makes it possible to reformulate the emulsion ink, if necessary (i.e. if the water content thereof is too low or too high), without having to wait for the exhaustion of all of the emulsion ink that is in need of reformulation. This dramatically reduces the amount of print waste due to poorly formulated emulsion ink.

A restriction valve 51 ensures that the pressure in the conduit 62 is between about 10 psi (about 69 kPa) and about 20 psi (about 138 kPa). The restriction valve 51 ensures that there is adequate pressure in the ink distribution rail 60 and adequate pressure for filling the auxiliary reservoir 65, when necessary.

Figure 3:
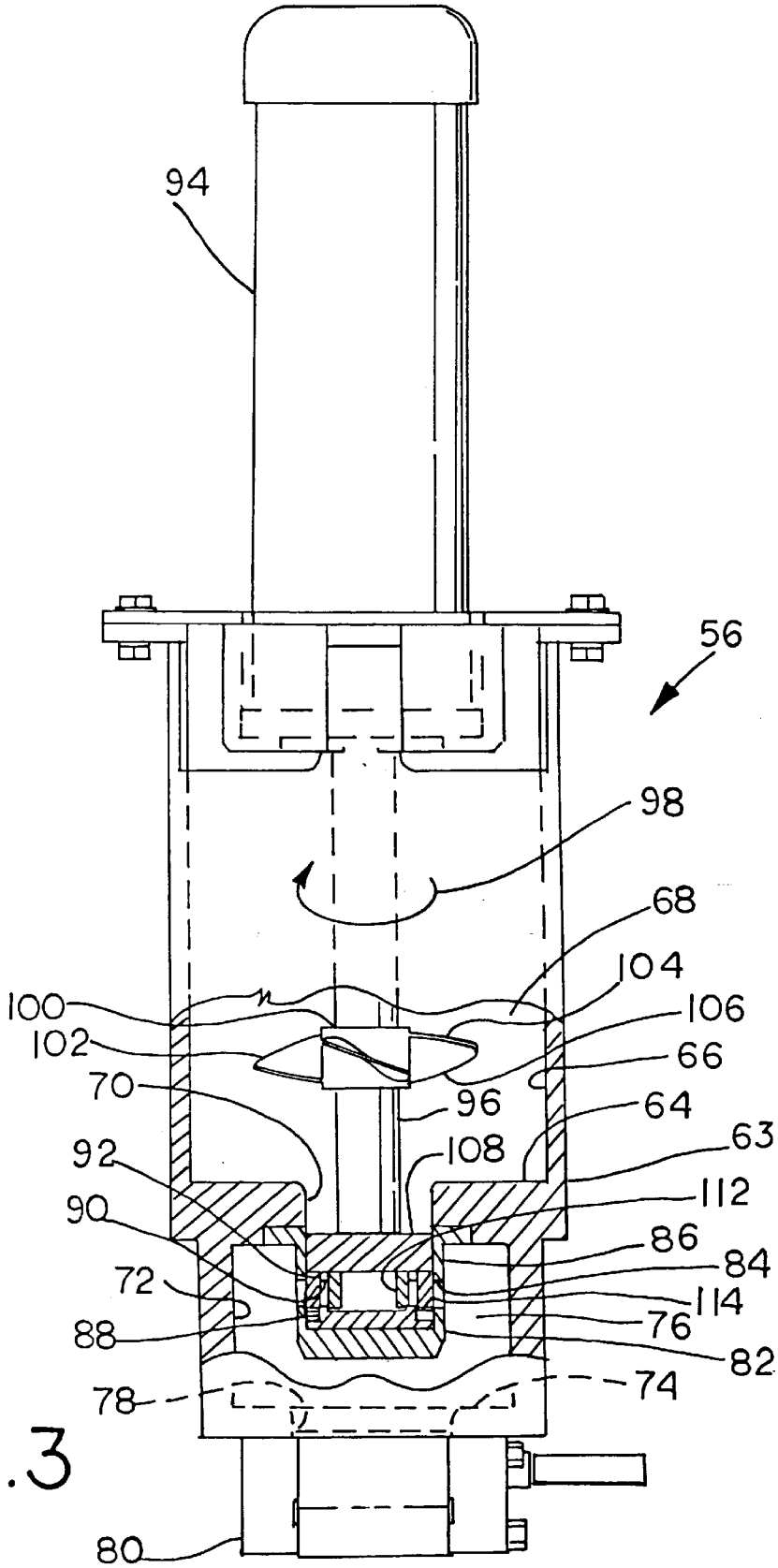
FIG. 3 is a side elevational view, partially in cross-section, of a liquid mixing and dispersing apparatus forming part of the emulsion ink feeding mechanism.
Figure 5:
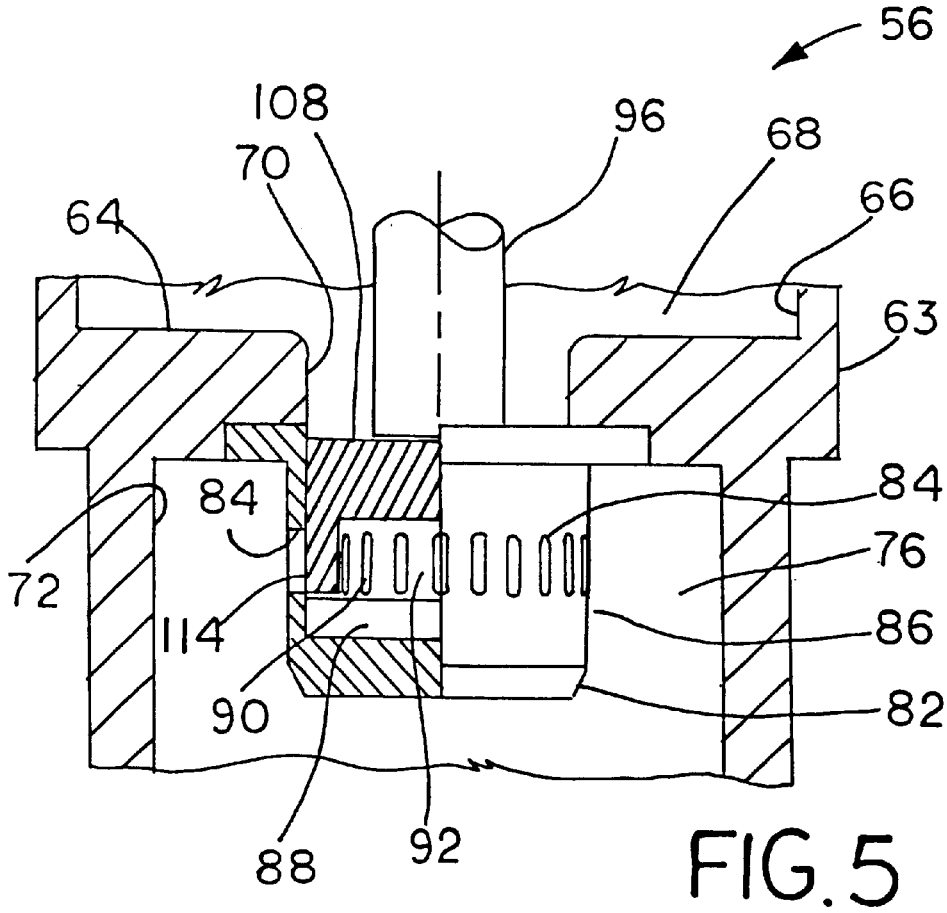
FIG. 5 is a fragmentary side elevational view showing the rotor, the inner stator member, and the outer stator member, partially in cross-section taken generally along lines 5—5 of FIG. 4.

With reference to FIGS. 3 and 5, the mixing and dispersing apparatus 56 includes a vessel 63 comprising a first circular horizontal wall 64, and a cylindrically-shaped upper vertical wall 66 having a height of about 21.0 cm and an inner diameter of about 17.8 cm, that together define a cylindrically-shaped upper chamber 68.

The first horizontal wall 64 has a circular opening 70 therein having a diameter of about 6.4 cm. The vessel 63 also includes a cylindrically-shaped lower vertical wall 72 having an inner diameter of about 13.8 cm, that is disposed directly below the first horizontal wall 64. The first horizontal wall 64, the cylindrically-shaped lower vertical wall 72, and a second circular horizontal wall 74, together define a cylindrically-shaped lower chamber 76. The second circular horizontal wall 74 has a substantially square-shaped opening 78 therein, having dimensions of about 8.0 by 8.0 cm, that leads to a gear pump 80, driven by a motor 81 (FIG. 2), that pumps emulsion ink out of the lower chamber 76.

A cup-shaped outer stator 82 is fixedly attached to the first horizontal wall 64 and is perforated by twenty four vertical slots 84 evenly distributed about an outer stator cylindrical wall 86, having a wall thickness of about 4.8 mm. A cup-shaped inner stator 88 is fixedly attached to the outer stator 82 and is perforated by sixteen vertical slots 90 evenly distributed about an inner stator cylindrical wall 92, having a wall thickness of about 4.0 mm. Each of the slots 84 and 90 has a height of about 15.9 mm and a width of about 3.4 mm.

A high-speed electric motor 94 is disposed above the upper chamber 68 and drives a motor shaft 96 in a clockwise direction as viewed from above, as indicated by an arrow 98. A propeller 100 is mounted to the motor shaft 96 for rotation therewith and comprises three propeller blades 102 equally angularly spaced apart from one another by 120 degrees and each pitched by an angle of about 20 degrees with respect to the horizontal such that a leading edge 104 of each propeller blade 102 is above a respective trailing edge 106 of each propeller blade 102. The propeller 100 has a diameter of about 12.7 cm and is mounted to the motor shaft 96 in the upper chamber 68 at a location that is preferably between one half to one full propeller diameter above the first horizontal wall 64.

Figure 4:
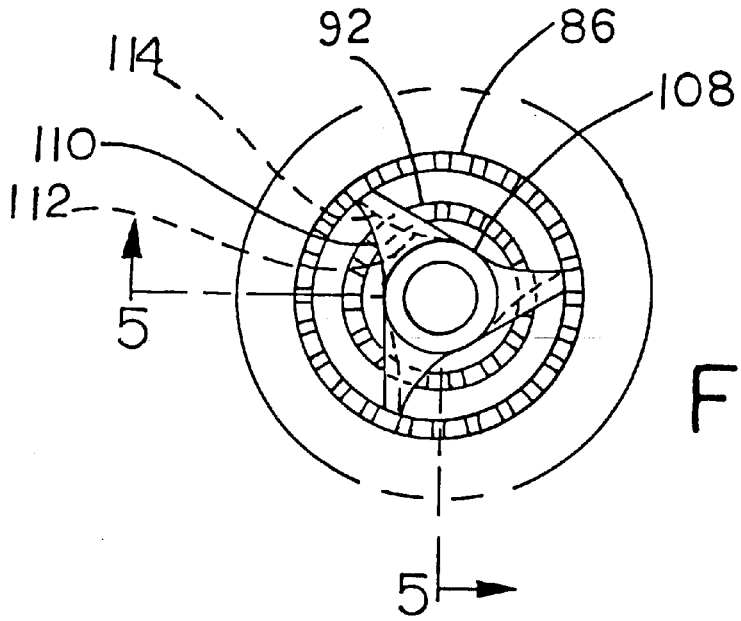
FIG. 4 is a plan view showing a rotor, an inner stator member, and an outer stator member forming part of the liquid mixing and dispersing apparatus.
Figure 6:
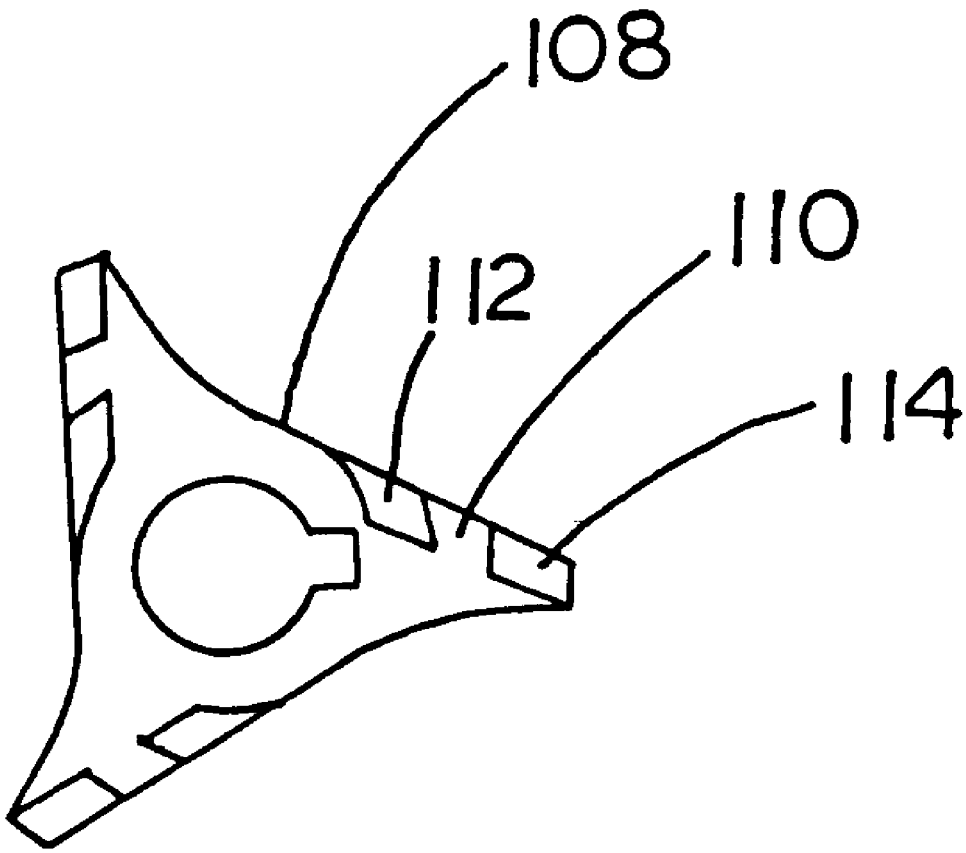
FIG. 6 is an elevational view, taken from below, showing the rotor.

A rotor 108 (best seen in FIGS. 4 and 6) is mounted to the lower end of the motor shaft 96 for rotation therewith. The rotor 108 includes three horizontal blades 110 that are equally angularly spaced apart from one another by 120 degrees. Each blade 110 includes a downwardly extending inner tooth 112 and a downwardly extending outer tooth 114. Each inner tooth 112 is disposed radially inwardly of the inner stator wall 92 and each outer tooth 114 is disposed between the inner stator wall 92 and the outer stator wall 86. A relatively close clearance of about 0.4 mm is provided between the teeth 112, 114 and the stator walls 86, 92.

In operation, the motor 94 is rotated at a speed of between about 500 and about 4,000 revolutions per minute, and the motor shaft 96, the rotor 108, and the propeller 100 rotate at the same speed as the motor 94. Due to the pitch of the propeller blades 102, the rotation of the propeller 100 causes the ink and fountain solution in the upper chamber 68 to mix together and to flow downwardly toward the rotor 108. The rotation of the rotor 108 shears the ink and fountain solution between the rotor teeth 112, 114 and the inner and outer stator walls 92 and 86. This shearing causes the formation of a fine emulsion ink that is dispersed through the slots 90 and 84 in the inner and outer stator walls 92 and 86 into the lower chamber 76. The emulsion ink is then pumped by the gear pump 80 to the conduit 57 (FIG. 2).

The propeller 100 pre-mixes the ink and fountain solution together and ensures that the fountain solution added to the upper chamber 68 does not simply sit on top of the ink surface and fail to mix with the ink matrix to form an emulsion ink having the desired water content. The propeller 100 also prevents a cavity from forming above the rotor 108, that would inhibit ink and fountain solution from flowing into the lower chamber 76.

Figure 7:
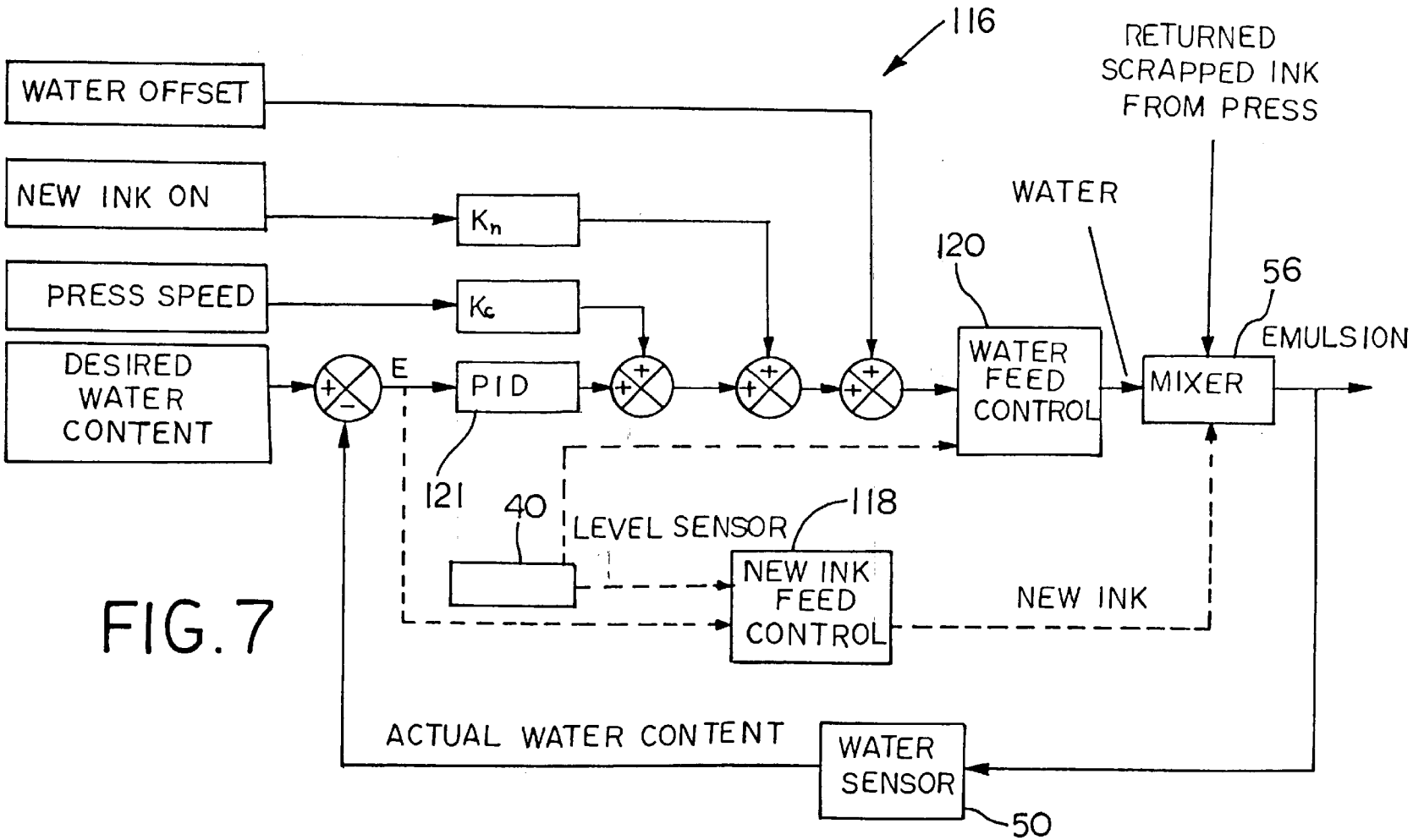
FIG. 7 is a schematic diagrammatic view of a control system for regulating the emulsion ink composition for the precision emulsion ink feeding mechanism.

With reference to FIG. 7, an electronic control system 116, for regulating the emulsion ink composition for the precision emulsion ink feeding mechanism, comprises a new ink controller 118 and a water content controller 120.

The control system 116 ensures that the liquid level in the mixing and dispersing apparatus 56 is maintained at an acceptable level. The control system 116 comprises the liquid level sensor 40 that includes an overflow sensor 122 and a minimum liquid level sensor 124, both of which are shown schematically in FIG. 2. New ink and/or fountain solution is added to the mixing and dispersing apparatus 56 from the ink supply reservoir 34, the fountain solution supply reservoir 44 and/or the auxiliary reservoir 65 if the liquid level in the mixing and dispersing apparatus 56 is too low, and emulsion ink is discharged from the mixing and dispersing apparatus 56 to the auxiliary reservoir 65 if the liquid level in the mixing and dispersing apparatus 56 is too high. Emulsion ink may also be discharged from the mixing and dispensing apparatus 56 to the auxiliary reservoir 65 if the water content of the emulsion ink is out of tolerance, so that either fresh ink or fountain solution can be added to the mixing and dispersing apparatus 56 from the ink supply reservoir 34 or the fountain solution supply reservoir 44, respectively, to quickly reformulate the emulsion ink without overflowing the mixing and dispersing apparatus 56.

The water content controller 120 uses both feedback and feedforward control strategies. The feedback control strategy is based on the difference between the desired water content value and the actual water content value, as sensed by the water content sensor 50, generating an error signal, E, which is input into a PID (proportional, integration, differentiation) controller 121.

The feedforward control strategy includes an input $K_n$, based on the status of the new ink valve 38, an input $K_s$, based on the press speed, and a water offset input that accounts for evaporation. The input $K_n$ accounts for the fact that, when the new ink valve 38 is open, fresh ink is being fed to the mixing and dispersing apparatus 56. The input $K_s$ accounts for the fact that, as press speed goes up, more scraped ink will be fed to the mixing and dispersing apparatus 56. The feedforward control strategy therefore anticipates the expected requirements for fountain solution and minimizes the error, E, that needs to be resolved by the PID controller 121. Accordingly, response time for necessary adjustments to the emulsion ink is minimized.

The operation of the water content controller 120 is also regulated by the new ink controller 118. For example, when the ink level is low, fresh ink will be pumped into the mixing and dispersing apparatus 56. This action will lower the water content of the emulsion ink in the ink feed and recirculation system 29. Hence, more water has to be pumped into the ink feed and recirculation system 29 to maintain a constant level of water content.

Figure 8:
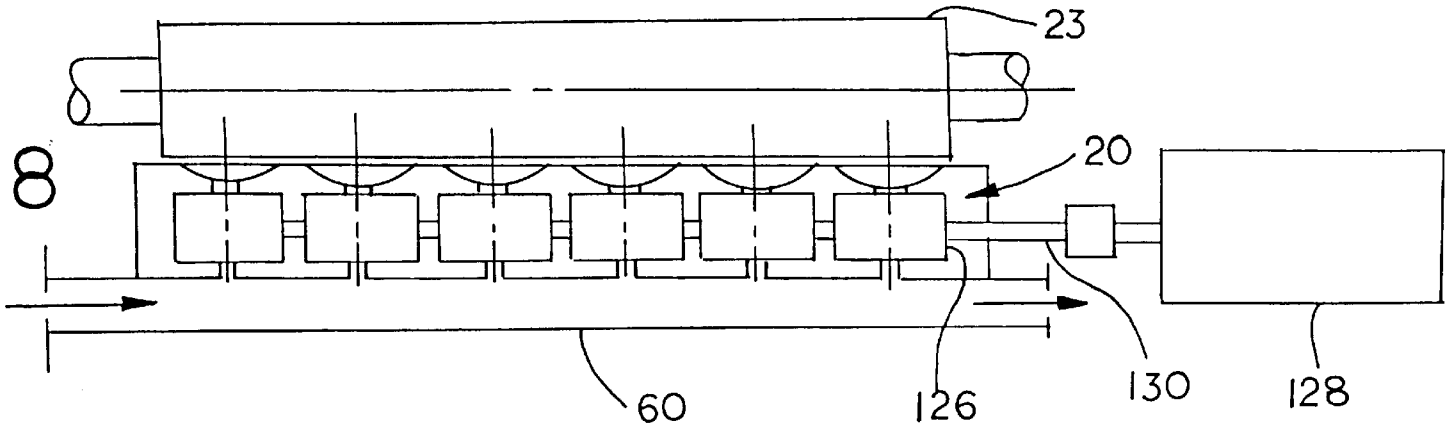
FIG. 8 is a schematic diagrammatic view of an ink distribution rail and fountain roller assembly forming part of the precision emulsion ink feeding mechanism.
Figure 9:
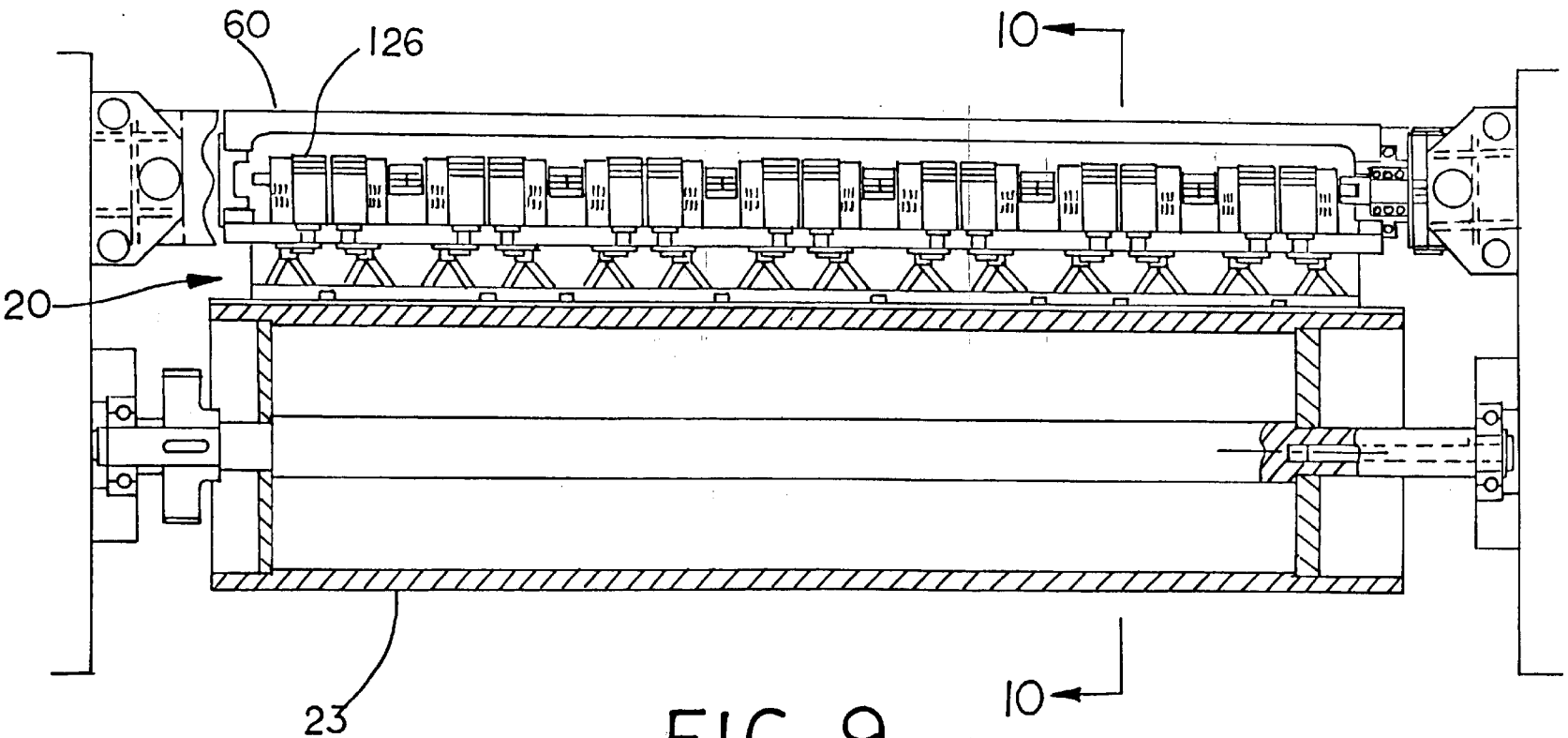
FIG. 9 is a plan view, partially in cross-section, of the ink distribution rail and fountain roller of FIG. 8.
Figure 10:
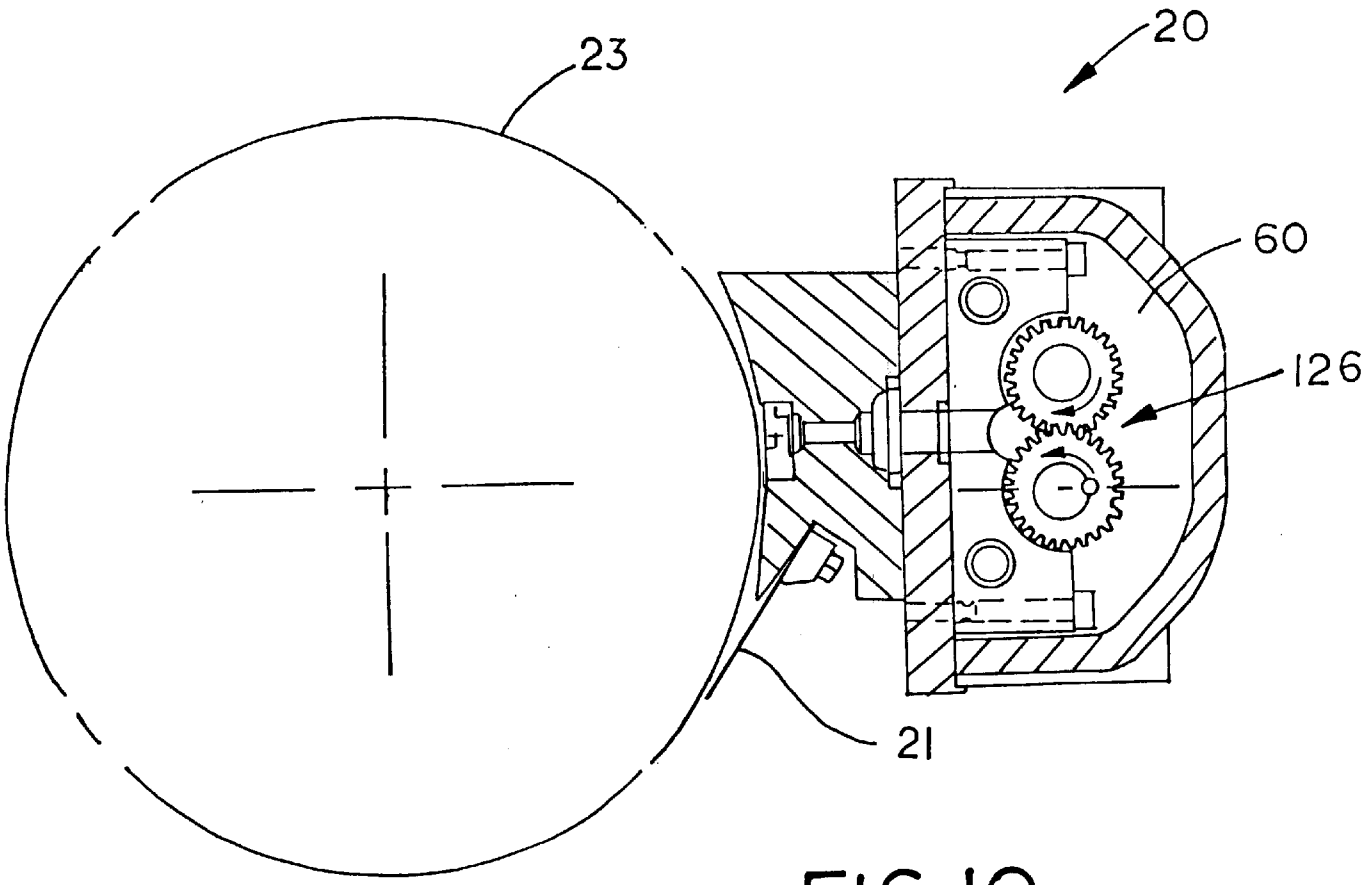
FIG. 10 is a cross-sectional view, taken generally along lines 10—10 of FIG. 9, of the ink distribution rail.

With reference to FIGS. 8–10, the digitally-controlled gear pump ink injector unit 20 comprises a plurality of positive displacement gear pumps 126 mounted within the ink distribution rail 60. Each of the positive displacement gear pumps 126 may be any suitable positive displacement pump, such as a diaphragm pump, a reciprocating piston pump, a moving vane pump, or a lobe pump. The positive displacement gear pumps 126 are driven by a single electric motor 128 by means of a single drive shaft 130. The positive displacement gear pumps 126 can be precisely controlled electronically, thereby providing optimal coverage of the fountain roller 23 with emulsion ink and providing the capability, for example, to proportionally control the flow rate through the positive displacement gear pumps 126 based on press speed. This makes it unnecessary to rely on a metering roll to achieve optimal coverage of the plate cylinder 16, and makes the printing press 10 reach a steady state fairly quickly.

Figure 11:
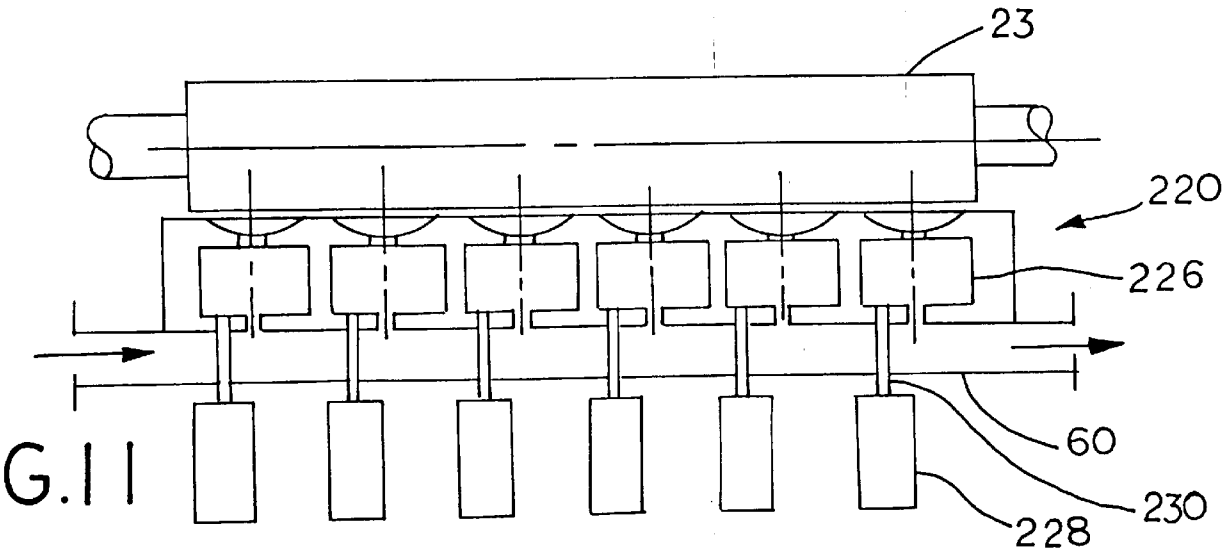
FIG. 11 is a schematic diagrammatic view of an alternative ink distribution rail and fountain roller assembly.

In an alternative embodiment, shown schematically in FIG. 11, a proportionally-controlled positive displacement pump ink injector unit 220 comprises a plurality of positive displacement pumps 226 mounted within the ink distribution rail 60. Each of the positive displacement pumps 226 is independently driven by a separate digitally-controlled electric motor 228 by means of a separate drive shaft 230, in order to allow a marginal differentiation of the ink feed rate of the positive displacement pumps 226, for example, to compensate for the effects of what are commonly known as starvation and ghosting.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A control system for regulating the composition of an emulsion ink made from an oil-based ink and a water-based fountain solution using a mixing and dispersing apparatus, for a lithographic printing press, the control system comprising:

a liquid level sensor adapted to provide an actual level of the emulsion ink in the mixing and dispersing apparatus;

a first regulator adapted to regulate a water-based fountain solution content of the emulsion ink based at least on a desired water-based fountain solution content, an actual water-based fountain solution content of the emulsion ink, and the actual level of the emulsion ink; and a second regulator operatively coupled to the first regulator and adapted to regulate an oil-based ink content of the emulsion ink based at least on the desired water-based fountain solution content, the actual water-based fountain solution content, and the actual level of the emulsion ink.

2. The control system of claim 1, further comprising means for adding oil-based ink and water-based fountain solution into the mixing and dispersing apparatus if the level of the emulsion ink in the mixing and dispersing apparatus is too low.

3. The control system of claim 1, further comprising means for discharging the emulsion ink from the mixing and dispersing apparatus if the level of the emulsion ink in the mixing and dispersing apparatus is too high.

4. The control system of claim 1, further comprising means for discharging the emulsion ink from the mixing and dispersing apparatus if the content of the water-based fountain solution of the emulsion ink is outside of the predetermined range from the desired content of the water-based fountain solution.

5. The control system of claim 1, further comprising a water content sensor for measuring the content of the water-based fountain solution of the emulsion ink produced by the mixing and dispersing apparatus, the water content sensor having an output;

wherein the first regulator generates an error signal from a difference between the desired content of the water-based fountain solution of the emulsion ink and the output of the water content sensor.

6. The control system of claim 5, wherein the first regulator comprises at least a proportional control element using the error signal as its input.

7. The control system of claim 5, wherein the first regulator comprises a proportional, integral and differential control element using the error signal as its input.

8. The control system of claim 1, wherein the second regulator comprises means for anticipating expected water-based fountain solution requirements based on at least one sensed condition.

9. The control system of claim 8, wherein the sensed conditions include an input based upon a flow rate of fresh oil-based ink into the mixing and dispersing apparatus.

10. The control system of claim 8, wherein the sensed conditions include a water offset input to account for evaporation.

11. The control system of claim 8, wherein the sensed conditions include a press speed input.

12. The control system of claim 11, wherein the second regulator provides an additional amount of water-based fountain solution proportional to the press speed to the mixing and dispersing apparatus.

13. A lithographic printing press control system for regulating the composition of an emulsion ink made from an oil-based ink and a water-based fountain solution using a mixing and dispersing apparatus, the mixing and dispersing apparatus having an oil-based ink input and a water-based fountain solution input, the control system comprising:

a liquid level sensor for measuring emulsion ink level inside the mixing and dispersing apparatus, the liquid level sensor having an output;

means responsive to the output of the liquid level sensor for maintaining a proper emulsion ink level in the mixing and dispersing apparatus;

a water sensor for measuring water content of the emulsion ink produced by the mixing and dispersing apparatus, the water sensor having an output;

means for regulating the water-based fountain solution input rate based on the output of the liquid level sensor, a desired water content of the emulsion ink, at least one of the variables selected from the group consisting of press speed, oil-based ink input rate and water evaporation rate, and the output of the water sensor; and means for regulating the oil-based ink input rate based on the output of the liquid level sensor, the desired water content of the emulsion ink, and the output of the water sensor.

14. The control system of claim 1, wherein the first regulator is a feedback regulator.

15. The control system of claim 1, wherein the second regulator is a feedforward regulator.

16. A method of regulating a composition of an emulsion ink made from an oil-based ink and a water-based fountain solution using a mixing and dispersing apparatus, for a lithographic printing press, the method comprising:

measuring an actual emulsion ink level in the mixing and dispersing apparatus;

determining an amount of water required to maintain the emulsion ink level in a desired emulsion ink level range based at least on a desired water content in the emulsion ink, an actual water content in the emulsion ink, and the actual emulsion ink level;

determining the amount of ink required to provide the composition of the emulsion ink based at least on the desired water content, the actual water content in the emulsion ink, and at least the actual emulsion ink level; and supplying the amount of the water required and the amount of the ink required to the mixing and dispersing apparatus to provide a desired level of emulsion ink in the mixing and dispersing apparatus.

17. The method of claim 16, wherein determining an amount of water required to maintain the emulsion ink level in a desired emulsion ink level range comprises:

measuring a water content error based on a difference between the desired water content in the emulsion ink and the actual water content in the emulsion ink, wherein the actual water content is measured with a water senor; and determining an amount of water required to maintain the emulsion ink level in a desired emulsion ink level range based on the water content error and at least one of the variables selected from the group consisting of press speed, ink input rate and water evaporation rate.

18. The method of claim 17, wherein determining the amount of ink required to provide the composition of the emulsion ink is based on difference between the desired water content in the emulsion ink and the actual water content in the emulsion ink, wherein the actual water content is measured with a water senor.

* * * * *

UNITED STATES PATENT AND TRADEMARK OFFICE

CERTIFICATE OF CORRECTION

PATENT NO. : 6,698,353 B2
DATED : March 2, 2004
INVENTOR(S) : Shem-Mong Chou et al.

It is certified that error appears in the above-identified patent and that said Letters Patent is hereby corrected as shown below:

Column 9,
Line 12, delete “senor” and insert instead -- sensor --.

Column 10,
Line 10, delete “senor” and insert instead -- sensor --.

Signed and Sealed this

Ninth Day of November, 2004

JON W. DUDAS
*Director of the United States Patent and Trademark Office*